US006293446B1

(12) United States Patent
Nielsen

(10) Patent No.: US 6,293,446 B1
(45) Date of Patent: Sep. 25, 2001

(54) PEGGED HOLSTERS AND SUPPORT MEANS

(76) Inventor: Richard E. Nielsen, 2040 E. Mier Rd., Midland, MI (US) 48642

( * ) Notice: Subject to any disclaimer, the term of this patent is extended or adjusted under 35 U.S.C. 154(b) by 0 days.

(21) Appl. No.: 09/351,114

(22) Filed: Jul. 10, 1999

(51) Int. Cl.[7] ..... F41C 33/02; F41C 33/04

(52) U.S. Cl. ..... 224/271; 224/192; 224/675; 224/911

(58) Field of Search ..... 224/191, 192, 224/195, 660, 674, 675, 271, 272, 911, 912

(56) References Cited

U.S. PATENT DOCUMENTS

| | | | | |
|---|---|---|---|---|
| 2,213,472 | | 9/1940 | Myres . | |
| 2,396,118 | * | 3/1946 | Ohlemeyer | 224/911 X |
| 2,443,397 | | 6/1948 | Myres . | |
| 2,504,369 | * | 4/1950 | Adair | 224/911 X |
| 3,265,259 | | 8/1966 | Marburger . | |
| 4,410,118 | * | 10/1983 | Taurisano | 224/911 X |
| 4,718,585 | * | 1/1988 | Atkins, Sr. | 224/911 X |
| 4,785,983 | * | 11/1988 | DeSantis | 224/911 X |
| 4,828,154 | | 5/1989 | Clifton . | |
| 5,054,670 | * | 10/1991 | Gallagher | 224/911 X |
| 5,246,153 | * | 9/1993 | Beletsky | 224/911 X |
| 5,358,160 | * | 10/1994 | Bianchi | 224/911 X |
| 5,775,558 | * | 7/1998 | Montalbano | 224/911 X |

* cited by examiner

*Primary Examiner*—Gregory M. Vidovich
(74) *Attorney, Agent, or Firm*—Robert L. McKellar

(57) ABSTRACT

A pegged holster and a means of supporting such holster. The holster is capable of being worn under the arm without the aid of shoulder straps. The holster is also capable of being manufactured such that the heighth of the holster from the belt line and/or the arm pit can be easily adjusted for individuals using such devices. The holster can also be easily exchanged for other holsters to accommodate various calibers and sizes of weapons.

16 Claims, 5 Drawing Sheets

PEGGED HOLSTERS AND SUPPORT MEANS

The invention disclosed and discussed herein deals with pegged holsters and a means of supporting such holsters. The holster of this invention is capable of being worn under the arm without the aid of shoulder straps. The holster of this invention is capable of being manufactured such that the height of the holster from the belt line and/or the arm pit can be easily adjusted for individuals using such devices. The holster can also be easily exchanged for other holsters to accommodate the various calibers and sizes of weapons in use today.

BACKGROUND OF THE INVENTION

This invention deals with holsters and devices for supporting them as they are being carried by a person. Devices for supporting and carrying pistols are well-known in the art and such devices can be found, for example, in U.S. Pat. No. 2,213,472, issued to Myres on Sep. 3, 1940 in which there is shown a holster which comprises a belt strap worn around the waist, an elongated pad-like pistol carrier equipped with straps for holding the carrier on the belt, and a spring clip to hold the pistol in place in an upside down arrangement. This device does not have any of the benefits of the device of the instant invention.

A second patent to Myres, U.S. Pat. No. 2,443,397, which issued on Jun. 15, 1948 shows a device similar to that shown in the '472 patent.

Another patent, U.S. Pat. No. 3,265,259, issued to Marburger on Aug. 9, 1966 shows a device also similar to the Myres arrangement, in that, the device is worn on a belt and has an arrangement in which the pistol can easily be extracted and replaced in the device.

Finally, U.S. Pat. No. 4,828,154, which issued May 9, 1989 deals with a hand tool organizer which includes a molded holster for a hand tool having a pistol grip. The holster has a supporting strap for suspending the holster from the waist belt of the wearer at a selected distance below the waist belt, that is, it is suspended from the belt. The organizer also has a leg encircling strap to hold the holster snugly against the leg, and it has optional attachments for holding a chuck key, a plurality of tool bits, a tool or nail bag, or several boxes of fasteners.

None of the devices disclosed and claimed in the prior art show or describe the devices of the instant invention, and none of the devices of the prior art have the advantages of the devices of the instant invention, which are described infra.

THE INVENTION

The invention disclosed and discussed herein deals with a pegged holster and a means of supporting such holster. The holster of this invention is capable of being worn under the arm without the aid of shoulder straps. The holster of this invention is capable of being manufactured such that the height of the holster from the belt line and/or the arm pit can be easily adjusted for individuals using such devices. The holster can also be easily exchanged for other pegged holsters to accommodate the various calibers and sizes of weapons in use today.

Thus, one objective of the instant invention is to provide a holster that can be sufficiently supported at the side of the wearer such that the holster and pistol can be worn close to the torso, stabilized, and retained in position.

A second objective of the instant invention is to allow for the simple expediency of changing the holster to accommodate a different sized pistol.

A third objective of the instant invention is to allow for the simple expediency of changing the holster to accommodate the different sizes of persons needing to wear such a device.

Thus, more specifically, one embodiment of this invention deals with a pegged holster that can be supported while being worn. The pegged holster comprises a holster for a pistol, a closing means for the holster and a support peg which can be rigid or flexible.

The holster has a back edge, a bottom edge, a front edge, a top, a bottom, a back panel, and a front panel, and the holster has a barrel opening at the front edge and between the back panel and the front panel. The holster also has a pistol opening at the back edge and between the back panel and front panel. In addition, the holster has securely fastened in the bottom, a support peg, which support peg extends beyond the bottom edge thereof.

The holster has securely mounted near the back edge, a first fastening means for closing the back edge of the holster and the holster has mounted on the outside of the back panel, a second fastening means for fastening the holster to a support means it being understood that a single fastening means can be used herein.

In another embodiment of the invention, the holster described just supra can be used in combination with a covered support means. Such support means comprises a cross-configured support having a vertical member consisting of a top long member, a bottom short member, and a cross arm having two ends extending laterally from the vertical member. In addition, the support means has a top end, a back, and a bottom end. The support means as indicated just supra, is a rigid or flexible material covered with a covering, wherein there is detachedly mounted on the covering, near the top end of the support means and on the back thereof, a support fastening means which is a tab. The tab extends beyond the top long member.

An upper portion of the long member has a hollow cavity capable of receiving a peg. Further, the cross arm has a curvature wherein there is a line concavity formed at the back of the cross arm. There is a belt loop attaching means located on the covering of the back of each of the two ends and there is located on each of the two ends, a detachable belt loop for attaching the device to a belt worn around the waist.

In yet another embodiment of this invention, the holster and support means can be worn in conjunction with a belt placed about the waist of the wearer.

In a further embodiment, the holster, and/or the support means can be adapted so that articles other than a pistol can be carried, such as ammunition clips, defensive spray canisters, flashlights, keys, communication devices, papers, currency, credit cards, knives, and other similar articles.

DETAILED DESCRIPTION OF THE DRAWINGS

Figure 1:
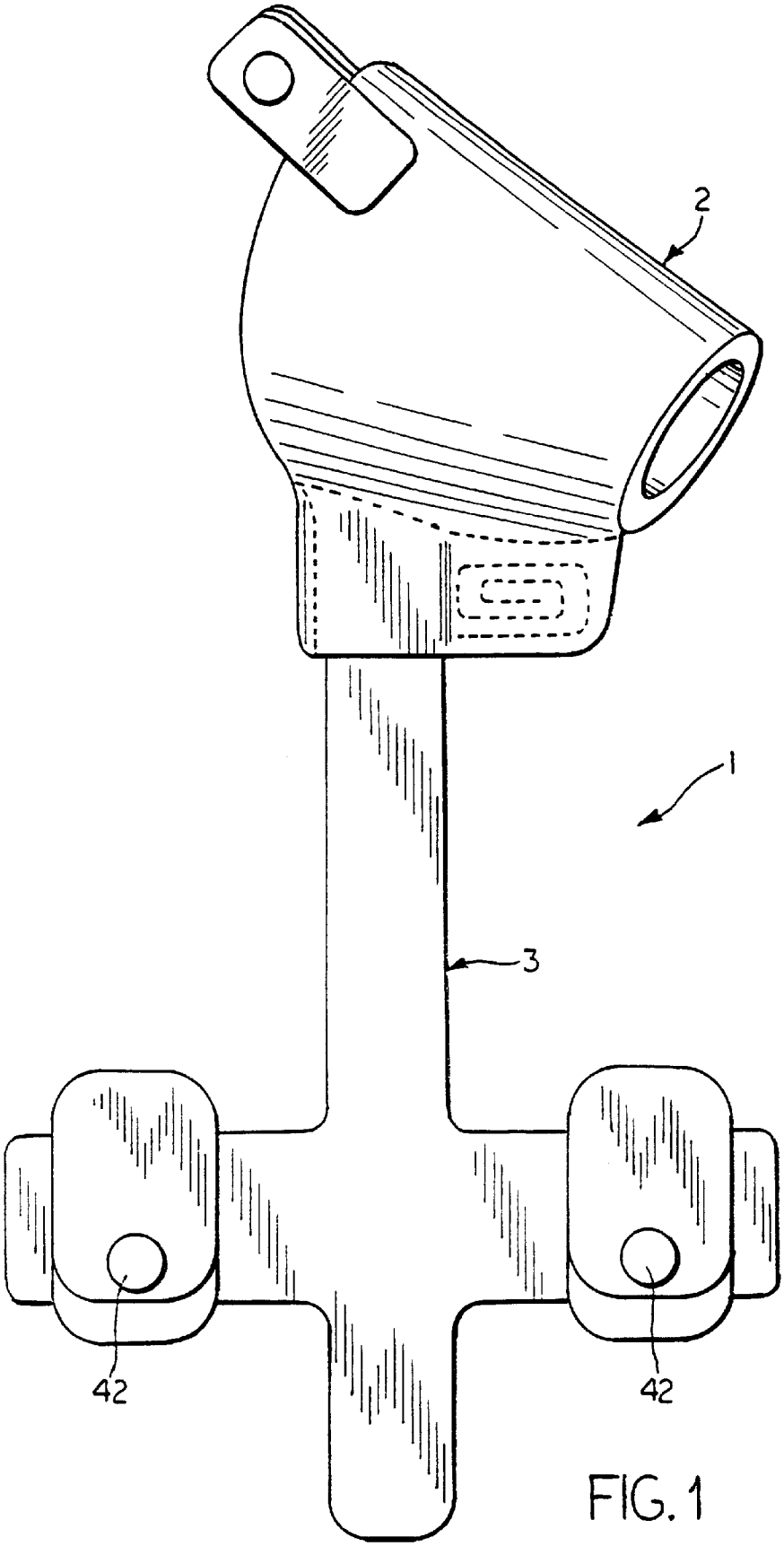
FIG. 1 is a full front view of the combination of the holster and the support means of this invention.

Turning now to FIG. 1 which is a full front view of the combination 1 of the pegged holster 2 and the support means 3, the details of which are set forth infra.

Figure 2:
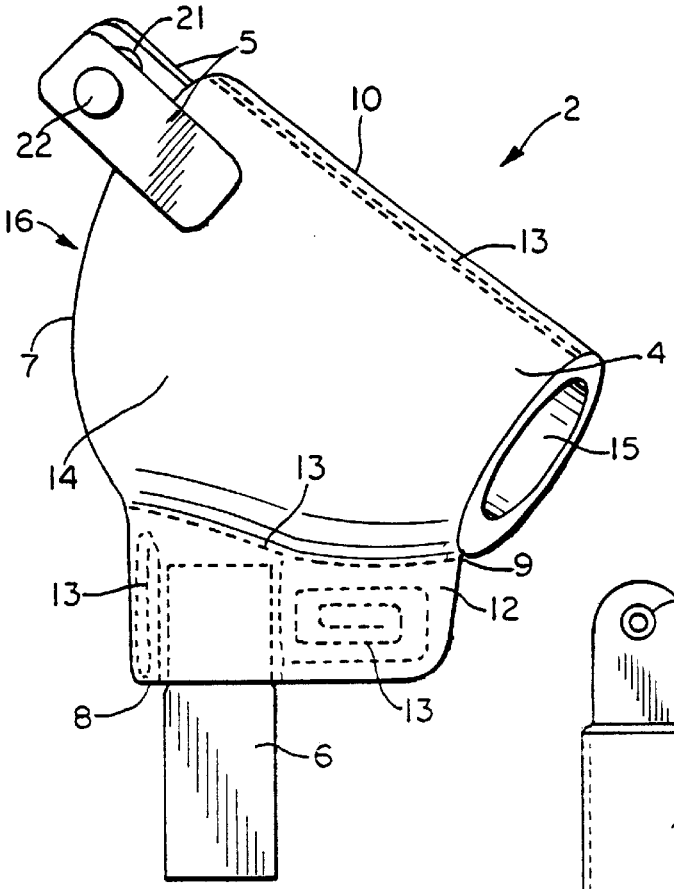
FIG. 2 is a full front view of the pegged holster.

Turning to FIG. 2, which is a full front view of the pegged holster 2 and which shows the holster 4, one embodiment of a closing means 5, and a rigid or flexible support peg 6. By the term "flexible", it is meant for purposes of this invention that the material is flexible enough that it will readily conform to the torso of the wearer, but is not so flexible that it will not support the holster and gun in the appropriate position vertically under the arm of the wearer. The holster 4 is shown as having a back edge 7, a bottom edge 8, a front edge 9, a top 10, a bottom 12, and a front panel 14. The illustrations herein are based on leather as the material from which the holster and the other elements are manufactured, and with this in mind, there is illustrated sew lines 13. Also shown is the barrel hole 15, which is configured such that it will allow the barrel of a pistol to 315 extend through it. The holster 4 also has a pistol opening 16 which cannot be observed in this Figure. Such a pistol opening allows for the insertion of a pistol into the holster, barrel first, such that the barrel extends through the barrel hole 15, and the remainder of the pistol rests inside of the holster 4. Upon complete insertion of the pistol, the fastener 5 is then fastened around the pistol at or near the hammer of the pistol to serve as a restraint for the pistol, and as a safety device to hold the hammer of the pistol in place to prevent accidental discharge of the pistol. This fastening is accomplished, for example, by utilizing the snap fastener male half 21 and the female 22. The top end 17 of the peg 6 is shown in phantom in FIG. 2. The peg 6 is glued into place and also the covering is sewn closely to the peg 6 such that the peg 6 is tightly retained in the holster bottom 12.

Figure 3:
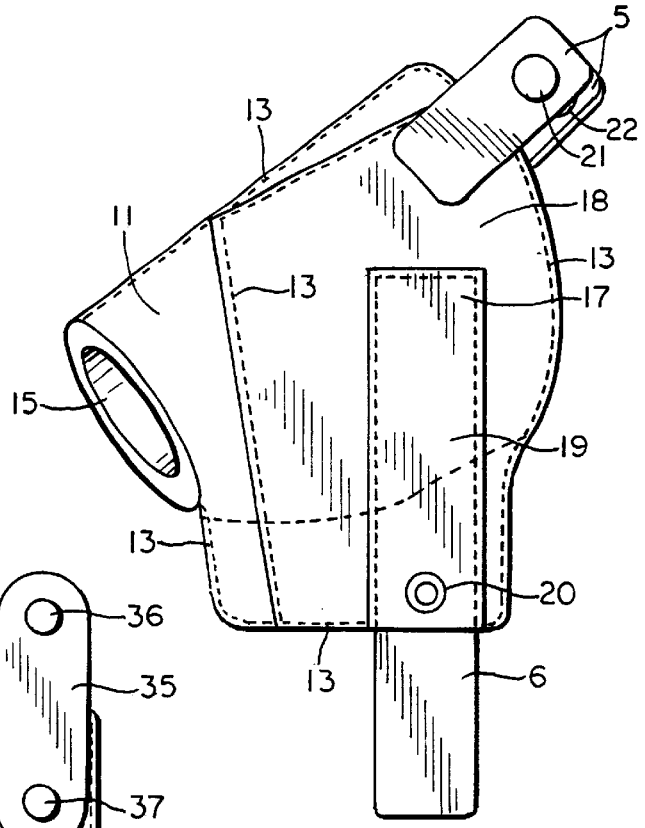
FIG. 3 is a full back view of the pegged holster.

Reference can be made to FIG. 3, which is a full back view of the pegged holster 2. Shown in FIG. 3 is the back panel 11, the tabbed fasteners 5, the backside of the peg 6, a reinforcing pad 18, a strip fastener 19, the male one-half 20 of a snap fastener, and the barrel hole 15. Also shown in phantom is the top end 17 of peg 6. As indicated earlier, the sewing lines 13 are also shown.

The reinforcing pad 18 and the strip fastener 19 accommodate the use of the snap fastener 20, as the reinforcing pad 18 reinforces the back panel 11 such that the strip fastener 19 can be attached at this point and such that the snap fastener attachment is strengthened. It is contemplated within the scope of this invention that neither the reinforcing pad 18 nor the strip fastener 19 are required to be utilized in this invention, but is preferred.

The holster, and the closing means, can be easily manufactured from materials such as plastics, for example, crosslinked polyethylene, fiberglass, leather, metal alloys, stiffened paper products, such as cardboard, or reinforced paper and cardboard.

The support peg for the holster can be manufactured from rigid or flexible materials, such as the crosslinked polyethylene as mentioned supra, rigid epoxy resins, and the like, fiberglass, leather, metal, such as aluminum and steel, exotic metals, alloys, and the like, carbon fibers, and, wood.

Preferred for the holster and the closing means is leather and plastics and most preferred is leather. Preferred for the support peg are rigid polymers and metals, especially steel and aluminum.

Figure 4:
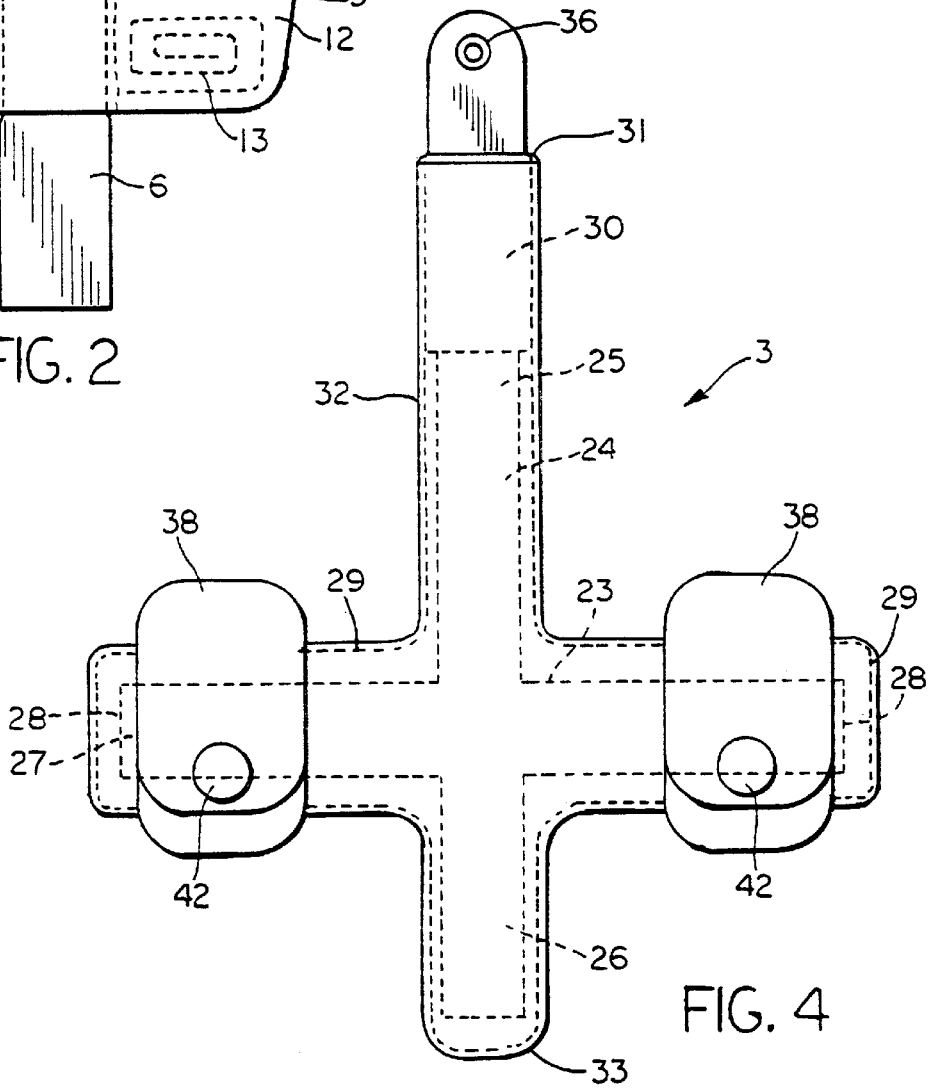
FIG. 4 is a full front view of the support means.

Turning now to FIG. 4, there is shown a full front view of the support means 3 of this invention in which there is shown a cross configuration 23 shown in phantom, which consists of a vertical member 24 having a long member 25, a short member 26, and a cross arm 27, having two ends 28 laterally extending therefrom. The cross configuration 23 is shown as encased in leather and therefore, there is shown some of the sew lines 29.

The support means has a top end 31, a back 32, and a bottom end 33. The long member 25 has an elongated cavity 30 (shown in phantom and also in a top view in FIG. 8) at the top end 31, which receives the rigid or flexible peg 6.

Figure 5:
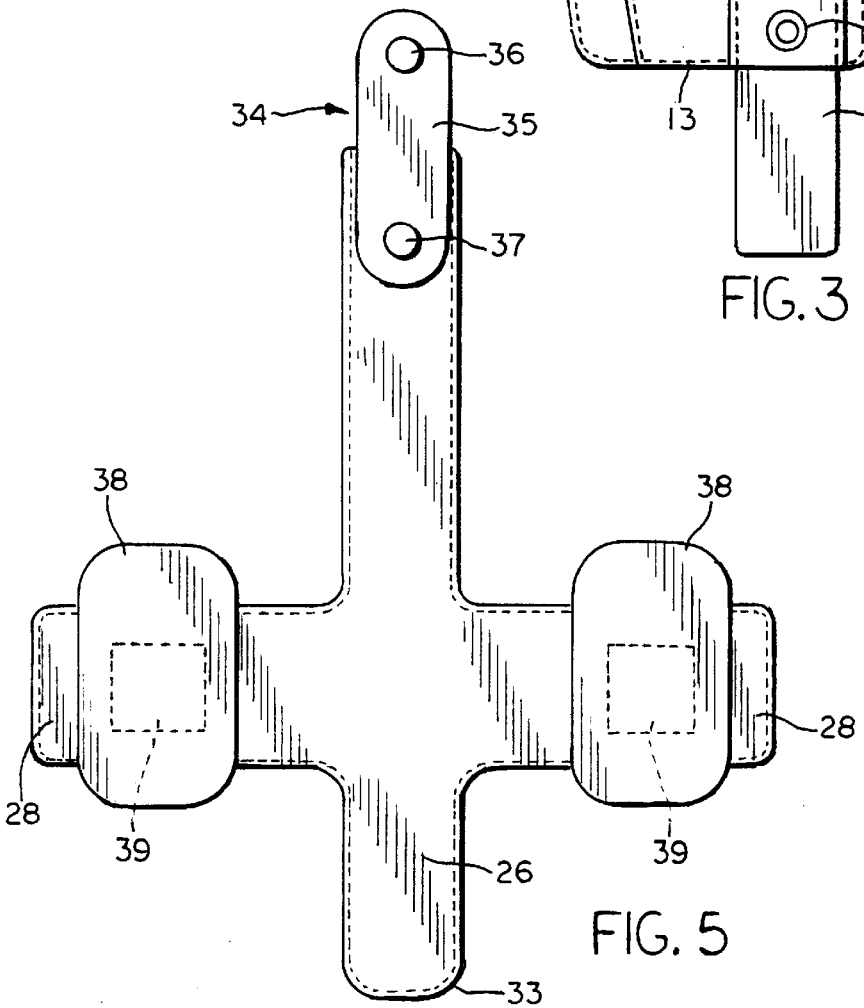
FIG. 5 is a full back view of the support means.

With reference to both FIGS. 4 and 5, wherein FIG. 5 is a full back view of the support means 3, there is shown a means 34 to hold the pegged holster 2 and support means 3 together. Such means 34 is shown as a strap 35 which has two male snaps 36 and 37, one in each end of the strap 35. The bottom snap 37 snaps onto a female snap, not show in the back of the support means 3, at near the top end 31. The other snap 36 snaps onto a female snap 20 (shown in FIG. 3), of the pegged holster 2 to securely hold the pegged holster 2 and the support means 3 together. It is contemplated within the scope of this invention to use other attachments means such as Velcro$^R$ or other hook and loop meand, or buckles, and the like. The only requirements are that the attachment means should not be bulky, and it should have the strength to hold the two pieces together securely.

Further, with reference to FIGS. 4 and 5, there is shown two belt loops 38, which wrap around the ends 27 respectively, and are attached to the ends 27 by a fastening means 39 such as hook and loop which is shown in FIG. 4, it being understood that the fasteners 39 are shown in phantom and that the fastening means 39 is between the back of the ends 27, and the belt loops 38, it being further understood that this particular fastening means is not critical and fastening means such as snaps and/or belts can be used herein. The belt loops 38 also have provision for fastening, as is shown in FIGS. 1 and 4, wherein snap fasteners 42 are shown The short end 26 is used to stabilize the support means 3 against the waist of the wearer. It is contemplated within the scope of this invention that the shape of the short end 26 can be any shape that is comfortable and that acts as a stabilizer. For example, the short end 26 can be a flat paddle shape or the short end 26 can be a flat triangular shape.

Figure 6:
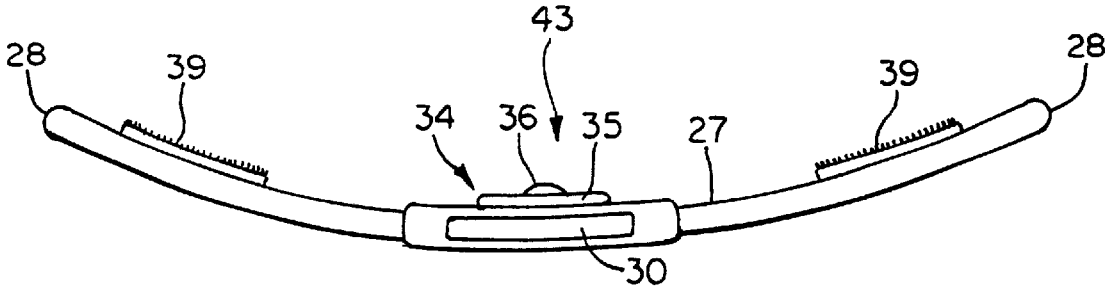
FIG. 6 is a full top view of the support means of FIG. 5.

The cross arm 27 has a concave shape with regard to the vertical member, as can be shown in FIG. 6, which is a full top view of the support means 3 without the belt loops 38 in place.

There is also shown the hook end of the fasteners 39. Also shown are the ends 28 of the cross arm 27. The inside of the concavity 43 is on the side worn against the waist of the wearer to accommodate the support means configuration at the waistline.

Also shown in FIG. 6 is the cavity 30, the strap 35 of the fastening means 34, and the snap 36 therefor.

Figure 7:
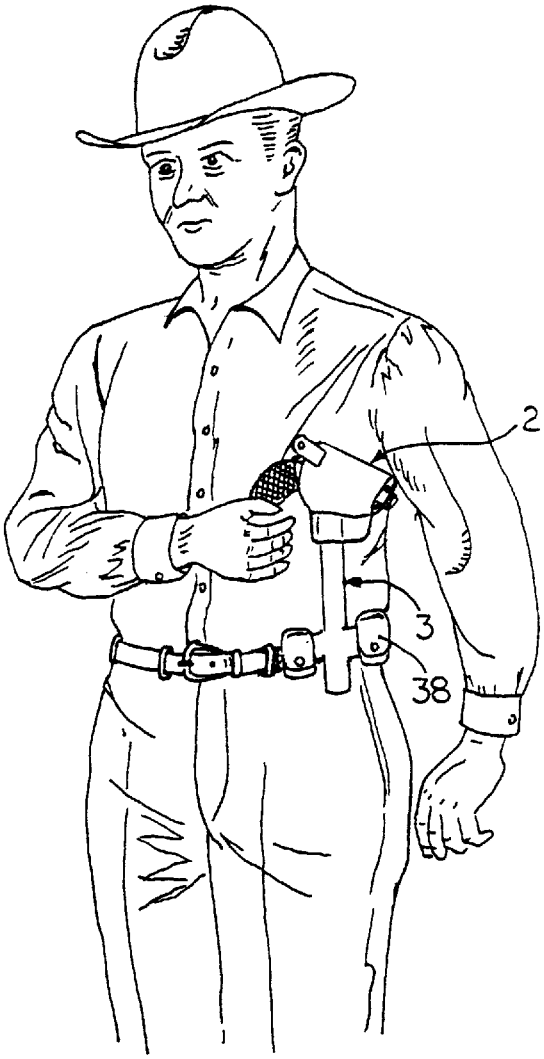
FIG. 7 is a view of a person wearing the combination of FIG. 1.

FIG. 7 is an illustration of a person wearing a device of this invention wherein like numbers have like meanings.

Figure 8:
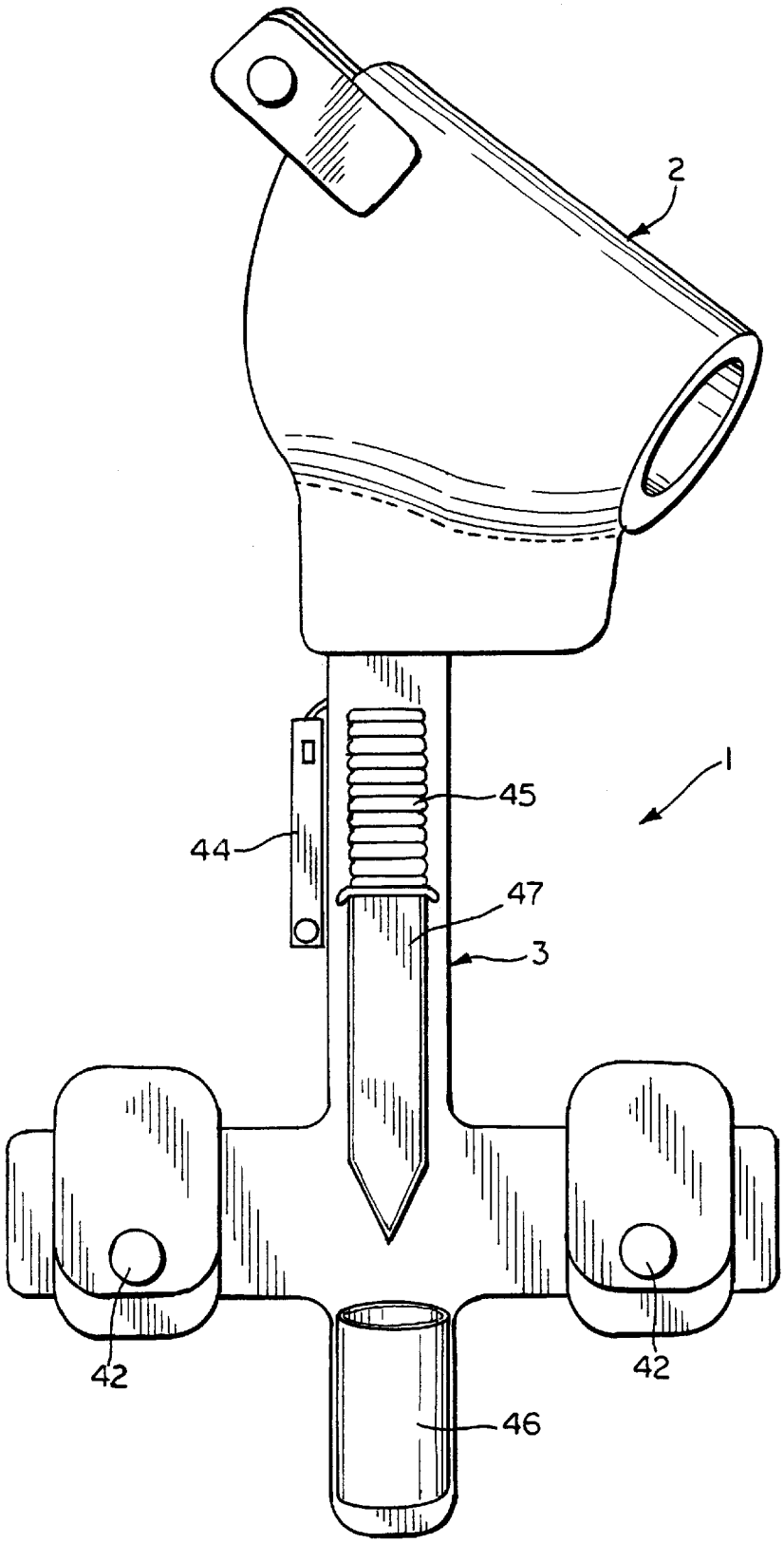
FIG. 8 is a view of FIG. 1 in which there is shown several means for carrying articles on the device.

FIG. 8 is a full view as shown in FIG. 1 in which there is shown means of carrying other articles on the device. For example there is shown a pen light 44, knife 45 in knife holder 47. Those understanding this invention, upon a reading of the specification will understand that other articles can be carried by the device of this invention, such as, ammunition clips, defensive spray canisters, keys, papers, communication devices, currency and the like a canister support 46 can be observed in FIG. 8.

As can be observed by those having ordinary skill in the art of holsters and the like, the device of this invention allows one to easily pull the pegged holster out of the cavity of the support means and exchange the holster for a different size or color, or the like. The support means is easily slipped onto the belt of a wearer by means of the belt loops and therefore, easily removed.

It should be further observed by those of ordinary skill in the art upon reading this specification, that the length of the peg 6 can be changed to change the length of the overall pegged holster and support means such that the device can be modified to fit the wearer.

The pegged holster, with the particular type of support means allows for the use of the device without additional shoulder straps, or torso straps, or the like to stabilize and support the holster and pistol therein.

What I claim is:

1. A pegged holster for a pistol, said pegged holster comprising:

a holster for a pistol;

a means for closing the holster;

said holster having a back edge, a bottom edge, a front edge, a top, a bottom, a back panel, and a front panel;

said holster having a barrel opening at the front edge and between the back panel and the front panel thereof; said holster having a pistol opening at the back edge and between the back panel and front panel thereof; said holster having securely fastened in the bottom thereof, a support peg, which support peg extends beyond the bottom edge thereof;

said holster having mounted on the outside of the back panel, a first fastening means for fastening said holster to a means for supporting said holster.

2. A pegged holster for a pistol as claimed in claim 1 wherein the means for closing the holster is a single tab mounted on the back panel of the holster and containing one-half of a compatible fastener and the second one-half of the compatible fastener is securely mounted on the front panel of the holster.

3. A pegged holster for a pistol as claimed in claim 1 wherein the means for closing the holster is a first tab which is mounted on the back panel and extends beyond the back edge thereof, a second tab which is mounted on the front panel and extends beyond the back edge, said first and second tabs being aligned opposite each other, said tabs each containing one-half of a compatible fastening means to connect the tabs securely together at their extended ends.

4. A pegged holster for a pistol as claimed in claim 1 wherein one or both of the holster for the pistol, and the closing means for the holster, are manufactured from a material selected from the group consisting essentially of:

(i) plastic;

(ii) fiberglass;

(iii) leather, and, (iv) paper products.

5. A pegged holster for a pistol as claimed in claim 1 wherein the support peg is manufactured from a material selected from the group consisting essentially of:

(a) rigid polymeric materials;

(b) flexible polymeric materials;

(c) fiberglass;

(d) leather;

(e) metal;

(f) carbon fibers and, (g) wood.

6. A pegged, supported holster for a pistol, said pegged supported holster comprising in combination:

(i) a pegged holster and, (ii) a covered support means for said pegged holster; said pegged holster comprising:

a holster for a pistol:

a means for closing the holster;

said holster having a back edge, a bottom edge, a front edge, a top, a bottom, a back panel, and a front panel;

said holster having a barrel opening at the front edge and between the back panel and the front panel thereof; said holster having a pistol opening at the back edge and between the back panel and front panel thereof; said holster having securely fastened in the bottom thereof, a support peg, which support peg extends beyond the bottom edge thereof;

said holster having mounted on the outside of the back panel, a first fastening means for fastening said holster to said support means;

said covered support means comprising a cross-configured support having a vertical member consisting of a top end long member, a bottom end short member, and a cross arm having two ends extending laterally from the vertical member; said support means having a top end, a back, and a bottom end, wherein said support means is covered with a covering, wherein there is detachedly mounted on the covering, near the top end of the support means and on the back thereof, a support fastening means which is a tab, said tab extending beyond the top end thereof;

an upper portion of the long member being a hollow cavity for receiving the a support peg; the cross arm having a curvature wherein there is a line concavity formed at the back thereof; there being a belt loop attaching means located on the covering for the back of each of the two ends; there being located on each of the two ends, a detachable belt loop.

7. A pegged, supported holster as claimed in claim 6, wherein there is also a belt for supporting the support means in the combination.

8. A pegged, supported holster for a pistol as claimed in claim 6 wherein one or both of the holster for the pistol, and the closing means for the holster, are manufactured from a material selected from the group consisting essentially of:

(i) plastic;

(ii) fiberglass;

(iii) leather, and, (iv) paper products.

9. A pegged, supported holster for a pistol as claimed in claim 6 wherein the support peg is manufactured from a material selected from the group consisting essentially of:

(a) rigid polymeric materials;

(b) flexible polymeric materials;

(c) fiberglass;

(d) leather;

(e) metal;

(f) carbon fibers and, (g) wood.

10. A pegged, supported holster for a pistol as claimed in claim 9 wherein the metal is aluminum.

11. A pegged, supported holster for a pistol as claimed in claim 9 wherein the metal is steel.

12. A pegged, supported holster for a pistol as claimed in claim 9 wherein the metal is an alloy.

13. A pegged, supported holster for a pistol as claimed in claim 9 wherein the metal is an exotic metal.

14. A pegged, supported holster for a pistol as claimed in claim 6 wherein the means for closing the holster is a single tab mounted on the back panel of the holster and containing one-half of a compatible fastener and the second one-half of the compatible fastener is securely mounted on the front panel of the holster.

15. A pegged, supported holster for a pistol as claimed in claim 6 wherein the means for closing the holster is a first tab which is mounted on the back panel and extends beyond the back edge thereof, a second tab which is mounted on the front panel and extends beyond the back edge, said first and second tabs being aligned opposite each other, said tabs each containing one-half of a compatible fastening means to connect the tabs securely together at their extended ends.

16. A pegged, supported holster for a pistol as claimed in claim 6, wherein the support means is manufactured from a material selected from the group consisting essentially of:

(a) rigid polymeric materials;

(b) flexible polymeric materials;

(c) fiberglass;

(d) leather;

(e) metal;

(f) carbon fibers and, (g) wood.

* * * * *